US007111956B2

(12) United States Patent
Brown

(10) Patent No.: US 7,111,956 B2
(45) Date of Patent: Sep. 26, 2006

(54) APPARATUSES AND METHODS FOR VISION ASSISTANCE

(75) Inventor: Nathan Derek Brown, Preston, WA (US)

(73) Assignee: Light-On, LLC, Preston, WA (US)

( * ) Notice: Subject to any disclaimer, the term of this patent is extended or adjusted under 35 U.S.C. 154(b) by 0 days.

(21) Appl. No.: 10/818,238

(22) Filed: Apr. 5, 2004

(65) Prior Publication Data

US 2005/0219837 A1 Oct. 6, 2005

(51) Int. Cl.
*F21W 121/06* (2006.01)

(52) U.S. Cl. ..... 362/106; 362/105; 362/183; 362/84; 2/209.13

(58) Field of Classification Search ..... 362/105, 362/106, 84, 183, 800; 2/209.13
See application file for complete search history.

(56) References Cited

U.S. PATENT DOCUMENTS

| | | | | |
|---|---|---|---|---|
| 4,525,878 | A * | 7/1985 | Lowe, Jr. | 2/209.13 |
| 4,827,384 | A | 5/1989 | Von Schlemmer | |
| 5,667,292 | A * | 9/1997 | Sabalvaro, Jr. | 362/106 |
| 6,056,413 | A | 5/2000 | Urso | |
| 6,659,618 | B1 * | 12/2003 | Waters | 362/106 |
| 6,721,962 | B1 * | 4/2004 | Polaire | 2/209.13 |
| 6,733,150 | B1 * | 5/2004 | Hanley | 362/106 |
| 2004/0264176 | A1 * | 12/2004 | Vanderschuit | |

* cited by examiner

*Primary Examiner*—Laura K. Tso
(74) *Attorney, Agent, or Firm*—Peloquin, PLLC; Mark S. Peloquin, Esq.

(57) ABSTRACT

A method includes inserting a light source into an item of head apparel, such that the light source is substantially contained within a volume of the item of head apparel. An apparatus includes a light source and a head apparel bill. The head apparel bill is configured to receive the light source, such that the light source is substantially contained within a volume of the head apparel bill and a user's vision can be assisted by light emitted from the light source.

57 Claims, 5 Drawing Sheets

FIG. 4
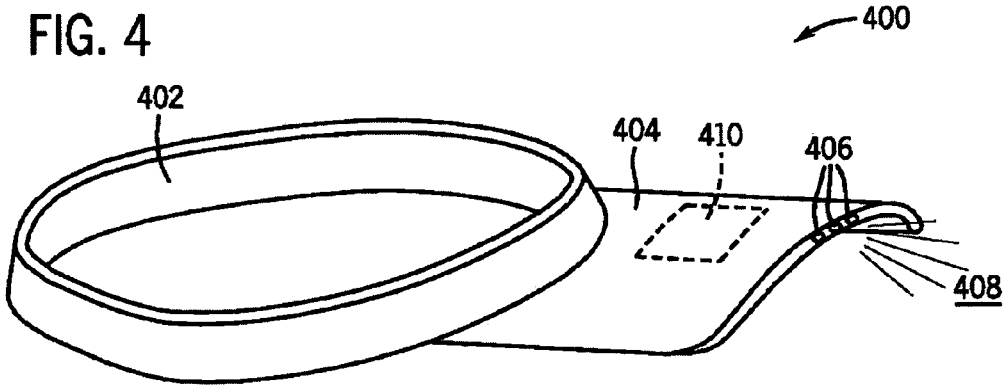
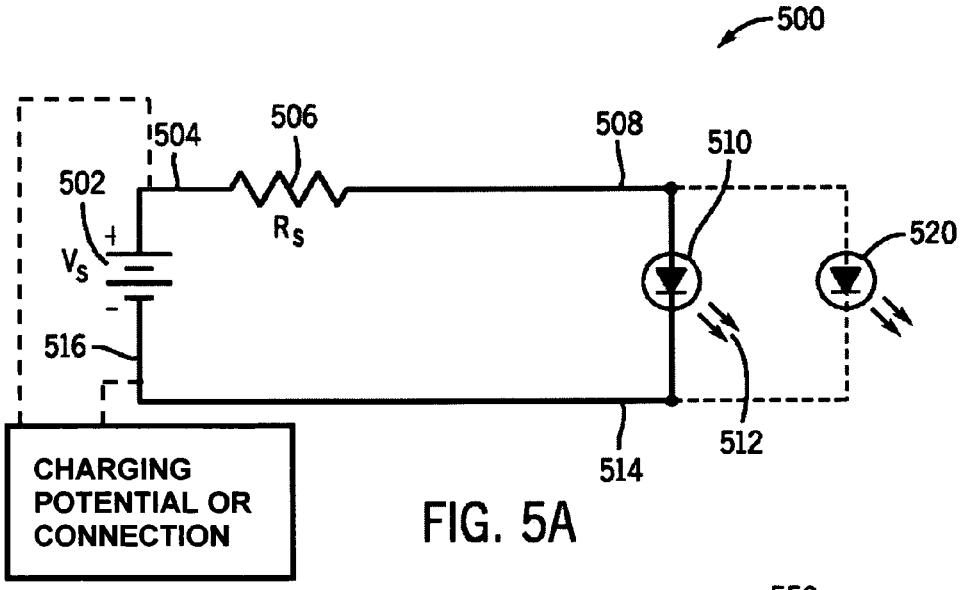
FIG. 5A
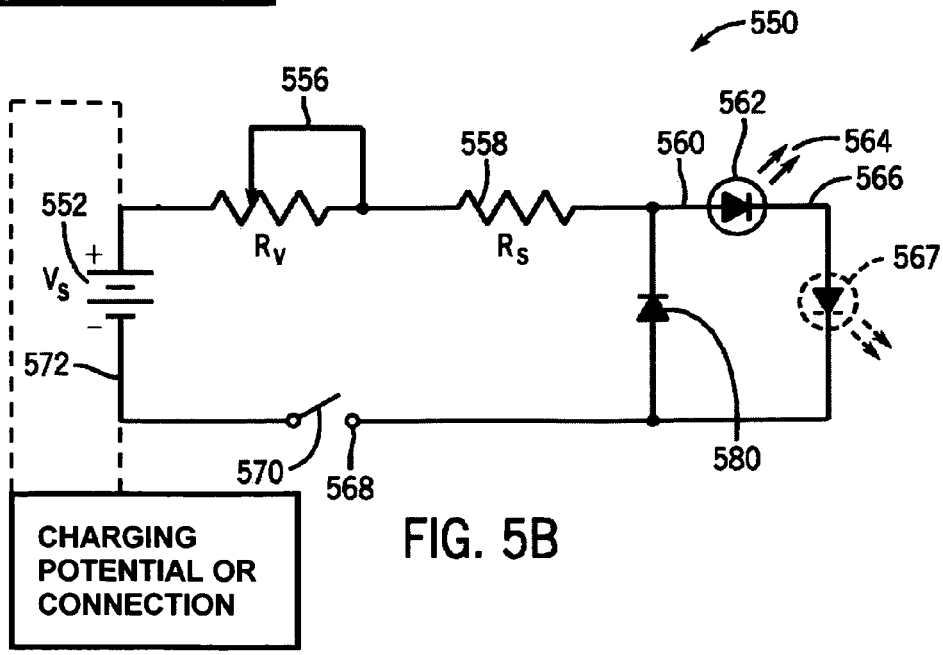
FIG. 5B 702
700
712
$t_1$
704
710
728
710
706
729
736
730
740
$t_2$
732
738
734
766
750
760
770
$t_3$
762
768
764

APPARATUSES AND METHODS FOR VISION ASSISTANCE

BACKGROUND OF THE INVENTION

1. Field of Invention

The invention relates generally to light emitting devices worn on a user's head, and more specifically to apparatuses and methods used to provide vision assistance from head apparel.

2. Art Background

Devices that produce auxiliary lighting and that are worn on a user's head are known by various names, one such device is a head lamp. A head lamp is a device that attaches a light source, such as a light bulb, and a power source, such as a battery, to a structure that can be worn on a user's head; thereby, aiding the user's vision when light is emitted from the light source. Generally, such devices can be worn directly on the user's head or over a hat or helmet if properly configured. Such devices have a defined volume, and are often heavy, having one or more canisters for housing batteries, light bulbs, and switches, while weighing between several ounces and up to a pound or more. Often weight and volume of such a device present a problem to the user.

In some cases, use of existing head lamps during activities undertaken in low light environments and/or during activities undertaken at night, including, running, jogging, walking, backpacking, mountain climbing, hunting, fishing, etc., present problems to a user. Use of existing head lamps during some low light activities can make the user feel uncomfortable and self-conscious since it is generally not culturally acceptable to wear a head lamp in some situations. Some situations that might make a user feel uncomfortable wearing and/or using an existing head lamp are riding on public transportation (bus, taxi, plane, and train), reading in bed, reading while watching a movie, etc. Use of existing head lamps during some sport activities can present a health hazard to a user. Ultra Marathon Mountain running can necessitate running for many hours at a time with a head lamp suspended from a user's head, which can present a physical problem to the user due to the suspended weight. A static weight, resulting from a head lamp suspended from a user's head places a static load on the user's anatomy, such as the user's vertebrae and associated muscular system. When the user undertakes activity that imparts impact loads to the user's anatomy dynamic loads are generated. These dynamic loads are larger in magnitude than the static loads and can load and strain the user's anatomy to an unacceptable level. Activities such as Marathon Mountain running, running, and jogging can present a problem to some users when conventional head lamps are used.

An effort to incorporate a light into a form of head gear, such as a cap, is found in U.S. Pat. No. 6,056,413, titled "Cap Lamp," to Urso [Urso]. Urso teaches pivotally mounting a light source to a visor of a cap. Another effort to integrate a light with a cap is found in U.S. Pat. No. 4,827,384, titled "Pocketed Headwear," to Von Schlemmer [Von Schlemmer]. Von Schlemmer teaches a means for removably holding a flashlight in a pocket of a visor. Both of these attempts have produced devices that attach a light to a cap. The light still requires either a separate canister to contain its volume and to package the light as a suitable attachment to the hat or the light is an existing flashlight having its own volume and weight. Such canisters are conspicuous to an observer of the cap which can make a user self-conscious and not want to use the cap in some situations. The canisters are also susceptible to impact and damage through handling, this may present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements. In the drawings:

FIG. 4 illustrates an array of light sources according to one embodiment of the invention;

FIG. 5A depicts a circuit for powering a light emitting diode (LED) according to one embodiment of the invention;

FIG. 5B illustrates another circuit according to one embodiment of the invention;

DETAILED DESCRIPTION

In the following detailed description of embodiments of the invention, reference is made to the accompanying drawings, in which like references indicate similar elements, and in which is shown by way of illustration, specific embodiments in which the invention may be practiced. These embodiments are described in sufficient detail to enable those of ordinary skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Figure 1:
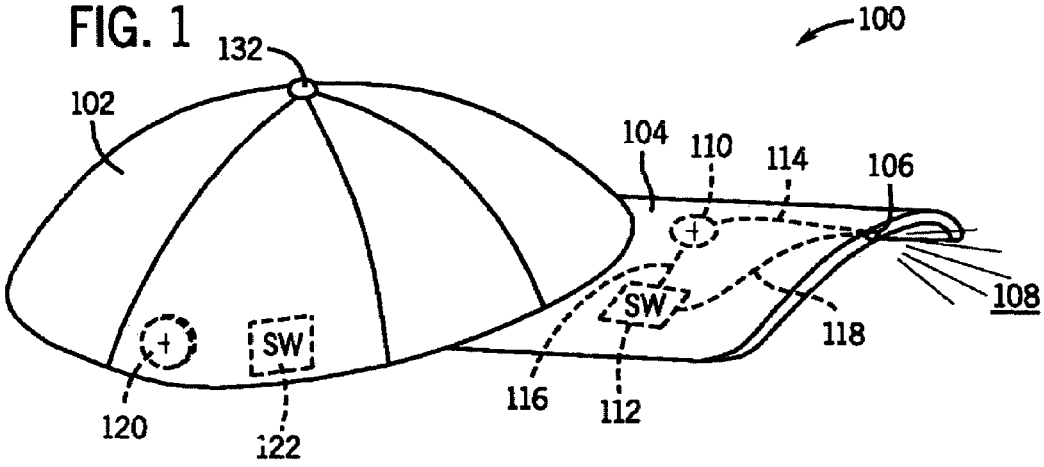
FIG. 1 illustrates one embodiment of the invention showing a light source incorporated into a bill of one form of head apparel.

An integration of head apparel with a light source is disclosed. FIG. 1 illustrates one embodiment of the invention showing a light source incorporated into a bill of one form of head apparel. With reference to FIG. 1, an item of head apparel is shown generally at 100. In one embodiment, the item of head apparel 100 is a cap. The cap is to be worn on a user's head (not shown). In the following description, reference will be made to "a user" or "the user;" however, to preserve clarity in the figures the user will not be shown. The item of head apparel 100 has a cupped portion 102 and a bill 104 attached thereto. The bill 104 functions as a visor, shading light from the user's eyes when worn in the presence of light, such as, sun light or artificial light.

A light source 106 is incorporated into the bill 104 and emits light 108 to assist the user's vision. A power source 110 is electrically coupled with the light source 106 via electrically conductive path 114. A switch 112 is electrically coupled with the power source via electrically conductive path 116 and the switch 112 is electrically coupled with the light source 106 via electrically conductive path 118. The switch 112 is used to open and close an electrical circuit of a lighting system formed with the components and electrically conductive paths described; thereby, turning on and off the light source 106.

In various embodiments, light source 106 is an array of light sources. In one embodiment, the light sources are all the same color; the array is used to increase the intensity of the light and/or to vary the shape of the light beam. In one embodiment, the array is comprised of different colored light sources. Each of the different colored light sources can be powered independently; thereby, allowing a user to select a color(s) of the light source(s) contributing to the array of light sources. Many different configurations of the array of light sources and colors are possible; the present invention is not limited thereby.

In various embodiments, different colored light sources can be selected by a switch used in the lighting system. For example, a switch can be configured to provide power to a number of different poles, wherein a different colored light source is attached to a given pole of the switch. In another embodiment, a switch can be coupled with or include an integrated circuit (IC). The IC is designed to function with the switch according to various logic scenarios, as is known to those of skill in the art. In one embodiment, the switch provides a pulse to an IC that changes the state of the IC. The IC is programmed to respond to a sequence of pulses from an external source (switch or sensor) where the first pulse causes the IC to provide current to a light source electrically connected thereto. The second pulse received by the IC causes the IC to terminate current flow to the light source. Another pulse (third pulse) produces the same result as the first pulse; thereby allowing a user to turn a light source on and off.

In another embodiment, an IC is programmed for five (5) states and the five states are utilized to turn on a plurality of different colored light sources. One logic sequence causes power to flow to a first light source when a first pulse is received by an IC from an external source (such as a user triggered switch or sensor). A second pulse, received by the IC, causes power to shift to a second light source. A third pulse received by the IC, causes power to shift to a third light source. A fourth pulse received by the IC, causes power to shift to a fourth light source. A fifth pulse, received by the IC, causes power to be terminated from all light sources. Many other logical sequences of operation can be programmed into an IC as is known by those of skill in the art, the present invention is not limited by the switch, the sensor or the combination of external input and IC used to provide power to a light source(s) within the teachings of the present invention.

In one embodiment, the power source is housed within the thickness of the bill 104. In one embodiment, the power source is a coin sized miniature lithium battery such as a CR2016 or a CR2450 manufactured by Eveready Battery Co. Inc. These batteries each provide a nominal voltage of three (3) volts; have a capacity of 80 and 575 (mAh), a thickness of 1.6 and 5.0 millimeters, and weigh 1.9 and 6.9 grams, respectively. One or more power sources can be configured in series to increase the voltage, for example two CR 2016 batteries can be wired in series to provide an electrical potential of six (6) volts. One or more power sources can be wired in parallel to increase the current while the nominal voltage remains at the individual battery rating of three (3) volts. A parallel configuration of power sources increases the capacity and permits a light source to be operated for a longer period of time. In one embodiment, circuits used to power a LED light source are described below in conjunction with FIG. 5A and FIG. 5B. In other embodiments, a miniature light bulb can be used such as an incandescent lamp, a xenon lamp, a halogen lamp, etc.

Alternatively, the power source 110 can be located at another position within the item of head apparel such as is indicated by power source 120. Many other positions at which to locate the power source 120 are possible; the present invention is not limited by the location of the power source 120. Similarly, the switch 112 can be configured for another location; such as the location indicated by switch 122. In one embodiment, a switch can be configured into a button 132 which is usually used at the apex of cap style head apparel such as the one shown at 100. Light source 106 can be located at another position on the bill 104 or light source 106 can be a plurality of light sources arranged in any fashion around the perimeter of the bill 104. In other embodiments, the light source is incorporated into a thickness of an item of head apparel. Not all items of head apparel have a bill; the absence of a bill from an item of head apparel does not preclude incorporating a light source and/or lighting system into the item of head apparel. For example, a light source and/or lighting system can be incorporated into a hair band, sweat band, helmet, etc., according to various embodiments of the invention. Positioning the power source and the switch in various locations requires electrical connection with the light source 106 so that an electrical circuit is completed which will allow the light source to be energized if an electrical source is utilized.

In one embodiment, a dimmer (not shown) is provided to adjust an intensity of a light source. In one embodiment, a width of the light beam (the illumination pattern) emitted from a light source is adjusted by an optical device, such as a lens placed in front of the light source. Adjustment of the optical device by a user is accomplished, in one embodiment, by providing for a variable distance between the light source and the lens. Other means for adjusting the illumination pattern can be utilized, such as but not limited to, a variable light aperture. In one embodiment, an optical device diffuses the light emitted from the light source. In one embodiment, the optical device is a diffuser; the diffuser is added in front of a light source to diffuse the light 108 making the light "gentler" to a user's eyes while the user utilizes the light 108 for a low light activity, such as reading in a low light environment.

Integration of a light source (and in some cases lighting system) into an item of head apparel provides a user with a light source that can be used discreetly and privately. The light source (an in some cases lighting system) is generally not readily discernable by a passerby apart from an inspection of the item of head apparel. In one or more embodiments, a user uses an item of head apparel so equipped with a light source for low-light activities, such as but not limited to, reading while riding as a passenger on public transportation, for example, a bus, a taxi, a train, an airplane, etc. Other activities include reading while watching television, reading in bed, reading in a movie theater, etc. In low-light environments, such as those described above, it is desirable to supply enough light so that a user can read without unduly straining his or her eyes while simultaneously not being offensive to other people proximate to the user which can be influenced by the user's auxiliary light.

In one or more embodiments, a light source and/or lighting system is incorporated into head apparel that is used by a user during the performance of a job related activity, such as but not limited to, a mechanic working in a low light situation (under a vehicle, etc.), performing a task in the bilge of a boat, a plumber performing a task in a low light area. In one embodiment, a pilot of a boat might prefer to use a red colored light source so that the emitted light is not offensive to other people in the cabin or to other boats passing by.

In one or more embodiments, a light source and/or lighting system is incorporated into an item of head of apparel to assist a user during the performance of an activity, such as running, jogging, walking, backpacking, hiking, mountain climbing, hunting, fishing, ultra marathon mountain running, skiing, etc. In different environments, colored light sources can be used to enhance a user's vision. For example, a green light source is sometimes preferred in some situations to enhance vision in flat light conditions. Flat light conditions can exist in snow covered terrain with an overcast sky, fog, or when it is snowing. Colored light sources can be preferred by users who do not want to alert animals to the presence of the user, in these situations green may be preferred.

Figure 2:
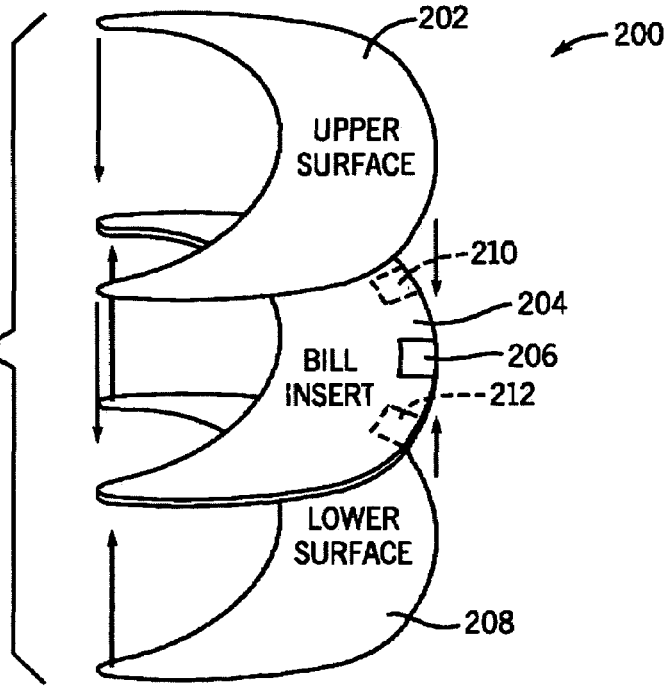
FIG. 2 illustrates a light source incorporated into a bill insert, of an item of head apparel, according to one embodiment of the invention.

FIG. 2 illustrates a light source incorporated into a bill insert, of an item of head apparel, according to one embodiment of the invention. With reference to FIG. 2, a bill assembly is shown generally at 200. The bill assembly 200 includes a bill insert 204 configured to accept a light source 206. Alternative or additional locations of the light source are indicated at 210 and 212. In one embodiment, light source 206 can include a light source holder and a light source, such as an LED socket and an LED. An upper surface 202 and a lower surface 208 sandwich the bill insert 204, assembled as indicated by the alignment arrows, to form a bill suitable for use on an item of head apparel such as the bill 104 in FIG. 1. Fastening the respective pieces of the bill can be accomplished, in various embodiments, by manufacturing techniques and processes, such as but not limited to, stitching, gluing, molding, etc.

Figure 3:
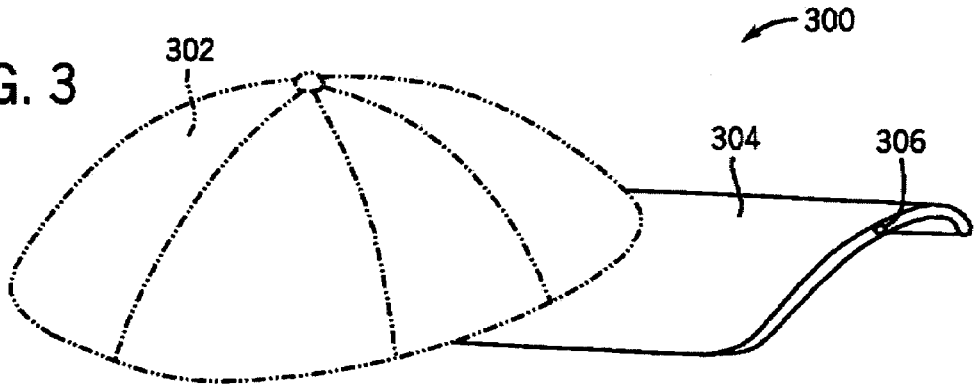
FIG. 3 illustrates a view of a head apparel bill insert according to one embodiment of the invention.

FIG. 3 illustrates a view of a head apparel bill according to one embodiment of the invention. With reference to FIG. 3, an integration of a light source and a head apparel bill is shown generally at 300 (an optional cap or hat is shown at 302). In one embodiment, a bill 304 can be made according to the construction described in conjunction with FIG. 2. In another embodiment, the bill 304 can be made from one uniform piece of material such as in a molding process utilizing plastic. Within a volume defined by the bill 304, a light source 306 is incorporated therein, such that the light source is substantially contained within the volume of the bill. In one embodiment, the light source and/or lighting system is completely contained within a volume of the bill. An optical device such as a lens and/or a diffuser can also be contained within the volume of the bill. Such optical devices provide for an adjustment of the width of the light beam and/or conditioning of the light beam to be more uniform and pleasing to the user's eyes. In other embodiments, the light source is contained within a volume defined by the item of head apparel. For example, some items of head apparel do not have bills, in such a case a light source is incorporated into a volume defined by the item of head apparel. In one embodiment, a light source is incorporated into a thickness of a helmet. Several helmets are described in conjunction with FIG. 7 below in accordance with embodiments of the invention. In another embodiment, a light source can be incorporated into a knit hat. In other embodiments, a light source can be incorporated into a hair band or a sweat band. Other embodiments will be recognized by those of skill in the art in light of the teachings herein. The present invention is not limited by a particular type of head apparel.

FIG. 4 illustrates an array of light sources according to one embodiment of the invention. With reference to FIG. 4, an item of head apparel incorporating a light source is shown generally at 400. A visor style item of head apparel has a bill or visor 404 and a strap 402. In this discussion, visor and bill are used synonymously; no limitation is implied by the use of one term over the other. Strap 402 can have a circumference adjustment (not shown) such as a buckle, elastic, or hook and loop closure, such as Velcro®, etc. The visor 404 and the strap 402 are coupled together to provide an integrated structure that can be worn on a user's head (not shown). One or more light sources 406 are incorporated into the bill 404 to provide light 408.

Also not shown in FIG. 4 are the power source and the switch used to open and to close the circuit that includes the light sources 406. In one embodiment, a recharging device is located on an upper side of the bill and is indicated at 410. In one embodiment, the recharging device is a solar cell that converts light into electricity and charges the power source thereby. In another embodiment, the recharging device is a connection into which an electromotive potential can be applied. The electromotive potential can be generated by an external source such as a charger that is powered by alternating current commonly available from household power outlets (nominally at 115 volts AC).

FIG. 5A depicts a circuit for powering a light emitting diode (LED) used as a light source according to one embodiment of the invention. With reference to FIG. 5A, a circuit is illustrated generally at 500. Circuit 500 includes a power source 502. The power source 502 can be one or more batteries previously described such as Eveready battery CR 2016 arranged in series to provide a nominal voltage of six (6) volts. In one embodiment, a cathode 514 of an LED 510 is electrically connected with the negative terminal 516 of the power source 502. An anode 508 of the LED 510 is connected with the positive terminal 504 of the power source 502. A current limiting resistor 506 can be used to limit the current flowing through the LED 510 and is configured in series as illustrated. An LED has a maximum forward voltage that depends on the type of semiconductor used for the LED. In one embodiment, a white light LED from NICHIA Corp., part number NSPW500BS, has a typical forward voltage of 3.6 volts and a typical DC forward current of 20 milliamps. A typical luminous intensity for the NSPW500BS LED is 6.4 candellas; the LED has an outer diameter of 5 millimeters. The beam width (directivity) of the LED is 20 degrees. A pair of Eveready CR 2016 batteries, configured in series for the power source 502, provides a nominal voltage of six (6) volts; the minimum value for resistor 506 to provide a forward current of 20 milliamps is 80 ohms. Using a larger value for resistor 506 will reduce the forward voltage applied to the LED and will limit the current flowing through the LED 510 resulting in less emitted light 512 from the LED 510.

One or more LEDs can be configured in parallel with LED 510, such as is indicated by LED 520 to provide additional light. The individual conductivity of paralleled LEDs can vary over time which may lead to differences in emitted light intensity between adjacent LEDs. In one embodiment, individual current limiting resistors can be used for each LED in the paralleled configuration; thereby, creating a uniform current flow through each of the LEDs configured in parallel.

Many other white light and colored light LEDs can be used as a light source, for example, part number NSPW300BS, also from NICHIA Corp. is a three (3) millimeter diameter LED that emits white light with a typical luminous intensity of 3.2 candellas. The LED has a typical forward voltage of 3.6 volts and a typical forward current of 20 milliamps and a beam width (directivity) of 25 degrees. Part number NSPG500S, manufactured by NICHIA Corp., emits green light at a wavelength of 520 nanometers. The typical luminous intensity is 11.6 candellas, with a typical forward voltage of 3.5 volts and a typical forward current of 20 milliamps. The beam width (directivity) of the LED is 15 degrees. Other light sources can be used in place of the LED and associated circuit or in addition to the LED and associated circuit, such as a chemiluminescent source described below in conjunction with FIG. 8. In other embodiments, a miniature light bulb can be used such as an incandescent lamp, a xenon lamp, a halogen lamp, etc.

FIG. 5B illustrates another circuit according to one embodiment of the invention. With reference to FIG. 5B, a schematic embodying brightness control (dimming) is shown generally at 550. A voltage source 552 is electrically connected with a variable resistor 556, a current limiting resistor 558, and an anode 560 of an LED 562. A cathode 566 of the LED 562 is electrically connected with a terminal 568 of a switch 570; the switch 570 is connected to the negative 572 terminal of the battery 552. Many different commercially available switches can be used for the switch 570. One such example is a single pole single throw (SPST) switch available from Panasonic, Corp., part number EVQPQHB55 or EVQPQMB55. In other embodiments, other switches or sensors are used for the switch 570, such as switches employing an integrated circuit (IC) from Quantum Research Group, Ltd. The circuit is completed when the switch 570 is closed; in such a state, the LED 562 emits light 564. The variable resistor 556 is adjusted by a user; thereby, varying the brightness of the LED 562. One or more LEDs can be configured in series as indicated by LED 567. In such a series configuration, the voltage source 552 must have a magnitude sufficient to sustain the cumulative voltage drops across all of the LEDs connected in series in order to provide light at the maximum forward LED voltage. Other configurations for an array of LEDs, such as the parallel configuration shown in FIG. 5A, can be used with the variable resistor 556 to control the brightness of the LEDs.

Reverse voltage protection can be incorporated into a circuit by placing a diode 580 in parallel with a LED and in a direction reverse to the LED. If a user inserts a battery into the circuit in a verse orientation, the diode will conduct before the reverse voltage applied to the LED becomes dangerously large.

Figure 6A:
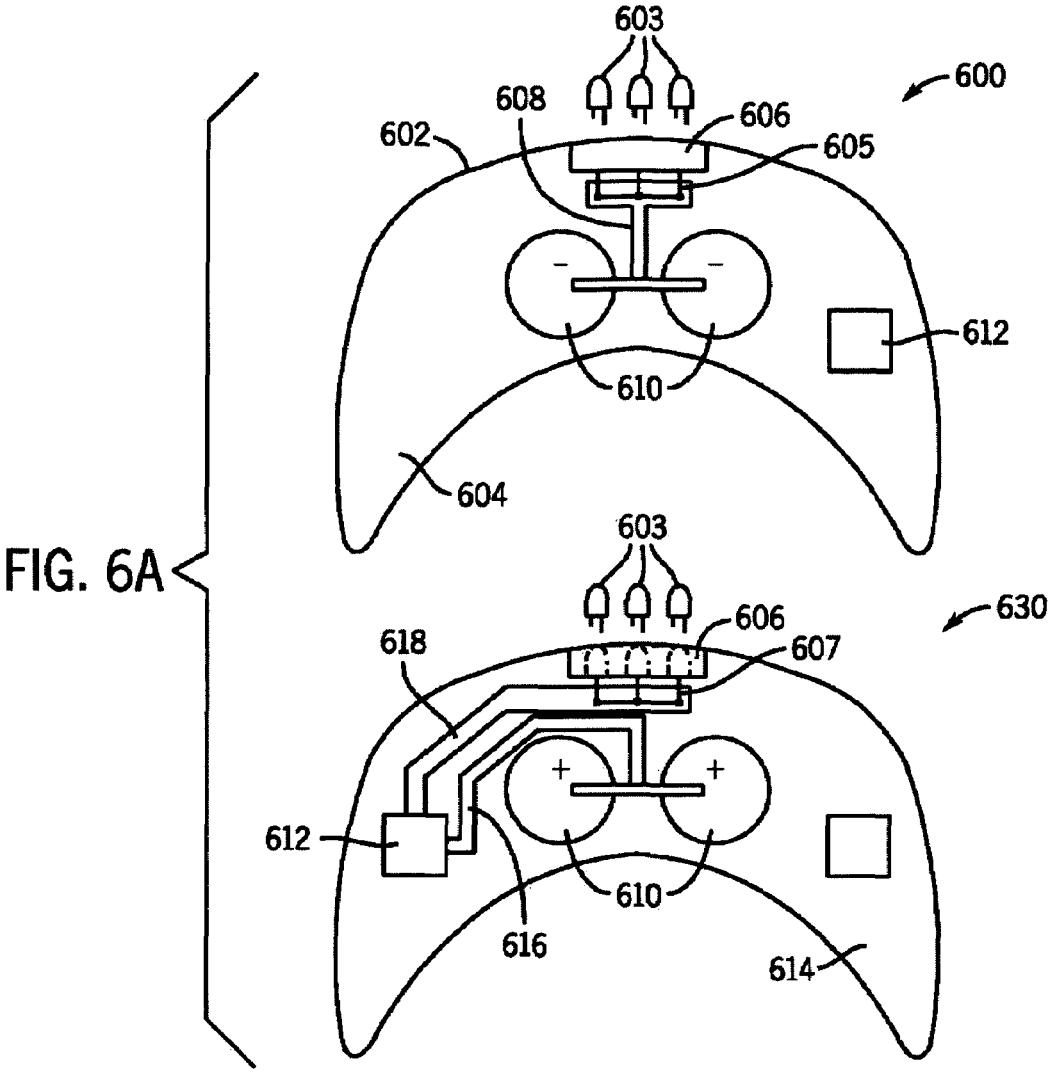
FIG. 6A illustrates a two sided circuit layout on a bill according to one embodiment of the invention.

Electrically conductive paths used to connect the components shown in the preceding figures can be made in a variety of ways. In one embodiment, wire can be used as the electrically conductive path. In another embodiment, a metalized film can be used to provide the electrically conductive path. In one embodiment, the electrically conductive paths can be incorporated into a bill of an item of head apparel to form a circuit board. FIG. 6A illustrates a two sided circuit layout on a bill according to one embodiment of the invention. With reference to FIG. 6A, a first side of a two sided circuit layout on a bill in shown generally at 600. A bill 602 has a first surface indicated at 604. The bill 602 is configured to contain one or more light sources 603 in location 606. The light sources 603 can be LEDs, as previously described, a light bulb, laser diodes, etc., the present invention is not limited by the type of light source used. In one embodiment, one or more power sources are located in the bill at 610. A switch is located at 612. In other embodiments, the switch and power sources can be located on another part of the item of head apparel as previously described. One polarity of the power source is electrically coupled along path 608 with a first terminal of the light source 605. If the light source is a diode based light emission device, then the cathode of the light emission device is connected to the negative polarity of the power source 610 to ensure a forward biased condition for the diode based light emission device, such as a LED.

In one embodiment, path 608 is a metalized strip of material that is bonded to the surface 604. In some forms of head apparel, that require through stitching, the stitching can pass through the path 608 without destroying the electrical continuity of the path 608. This technique can simplify construction of some forms of head apparel.

A second surface 614 (shown in 630) has a path 616 providing electrical continuity between a second terminal of the power source 610 and the switch 612. A path 618 provides electrical continuity between the switch 612 and a second terminal of the light source 607. If the light source is a diode based light emission device, then the anode of the light emission device is connected to the positive polarity of the power source to ensure a forward biased condition for the diode based light emission device, such as a LED.

In one embodiment, location 606 is a socket bundle configured to receive one or more light sources. In one embodiment, the socket bundle is configured to receive one or more LEDs when an LED is inserted into a socket that receives the anode and cathode of the LED; thereby fixing the LED in place. Location 606 can be configured for one LED or a plurality of LEDs according to various embodiments of the invention. In one embodiment, location 606 orients an array of LEDs at an offset angle or at offset angles. In one embodiment, an array of 3 (three) LEDs is configured to position the center LED on an axis perpendicular to a horizontal axis of a bill. Each LED adjacent to the center LED is positioned to point 20 (twenty) degrees away from the center LED. If LEDs are used that have individually a 20 degree beam pattern, then the combined beam pattern of the array of three LEDs is 60 degrees; thereby illuminating a wide field of view for the user.

Varying positions of the light sources can be used in other embodiments; the present invention is not limited by the previous example. For example, in one embodiment, an array of 5 (five) LEDs is used with the center 3 (three) LEDs aligned perpendicular the horizontal axis of a bill and the outer LEDs are positioned at an angle pointing away from the central three LEDs to widen the resulting composite beam of the array of light sources. Such an orientation places an emphasis on the center portion of the illumination pattern, weighting the center one third of the pattern three times as much as the outer third on either side of the center third. Other weightings are possible by adjusting the alignment of the sockets accordingly; the present invention is not limited to a particular directivity pattern.

In one embodiment, an array of light sources is comprised of different colors. For example, one light source is a white light source and a second light source is a green light source. A switch, as described in conjunction with the previous figures can include additional poles to power the different colored light sources individually. Thus a user can select a particular color for the light emitted by selecting a light source according to a position of a switch. A switch can be configured with an integrated circuit (IC), as previously described, to control the powering of the light sources. Various functionality can be incorporated into such a system that produces automatic "shut-off" after a period of on-time. In one embodiment, a switch includes a sensor and an IC.

For example, an external signal from a sensor, such as a photo detector can provide an input to the IC that causes the IC to supply power to the light source. In one embodiment, such a control system is provided with a light source suitable for use in a darkroom. When a user enters a darkroom, an absence of ambient light is used to signal the "on" condition for the light source. The "off" condition is triggered when the user leaves the darkroom and returns to a level of ambient light sufficient to trigger the switch. In one embodiment, a proximity sensor detects the presence of the user's head so that the light source is only turned on when the ambient light is low and the user is wearing the item of head apparel. Various other combinations of sensors and ICs can be used to regulate the flow of power to a light source; the present invention is not limited to any one configuration of sensor and IC.

Figure 6B:
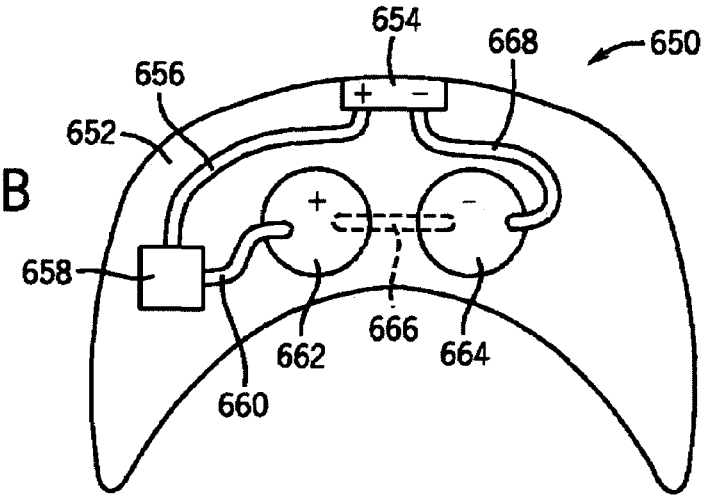
FIG. 6B illustrates a circuit layout attached to one side of a bill according to one embodiment of the invention.

FIG. 6B illustrates a circuit layout attached to one side of a bill according to one embodiment of the invention. With reference to FIG. 6B, a circuit layout is shown generally at 650. A bill 652 has a light source incorporated therein at 654. In one embodiment, the light source 654 can include a socket for releasably coupling one or more light sources thereto. Such a releasable coupling can facilitate replacement if one or more of the light sources should become inoperable. A power source is located at 662, and a second power source can be located at 664. A series configuration is indicated with the drawing since a negative terminal of power source 662 is connected to a positive terminal of power source 664 by conductive path 666. Alternate configurations (series and/or parallel combinations) of the power sources can be utilized as previously described to achieve a desired level of voltage and current.

A conductive path 668 connects the negative terminal of the power source 664 with one of the terminals of the light source 654. In one embodiment, a switch 658 mounted on the bill 652 is coupled by electrically conductive path 660 to the positive terminal of power source 662. The switch 658 is also coupled electrically by conductive path 656 to the light source 654. The switch 658 opens and closes the circuit to provide power to the light source 654.

In one embodiment, paths 666, 656, and 668 are metalized strips of material that are bonded to the surface of the bill 652. In some forms of head apparel, that require through stitching, the stitching can pass through the electrically conductive paths without destroying the electrical continuity of the paths. This technique can simplify construction of some forms of head apparel.

Some forms of head apparel such as caps, hats and visors contain bills. Various embodiments of the invention have been described wherein the bill of an item of head apparel has been utilized during the incorporation of the light source therein. Some forms of head apparel, traditionally, have not been configured with a bill, such as a hair band, head band, sweat band, etc. Embodiments of the invention are readily incorporated into such forms of head apparel. In other embodiments, tradition does not preclude a bill from being provided with such forms of head apparel, the present invention is not limited by tradition. In various embodiments, the present invention is incorporated into various forms of head apparel that either have or do not have bills.

Figure 7:
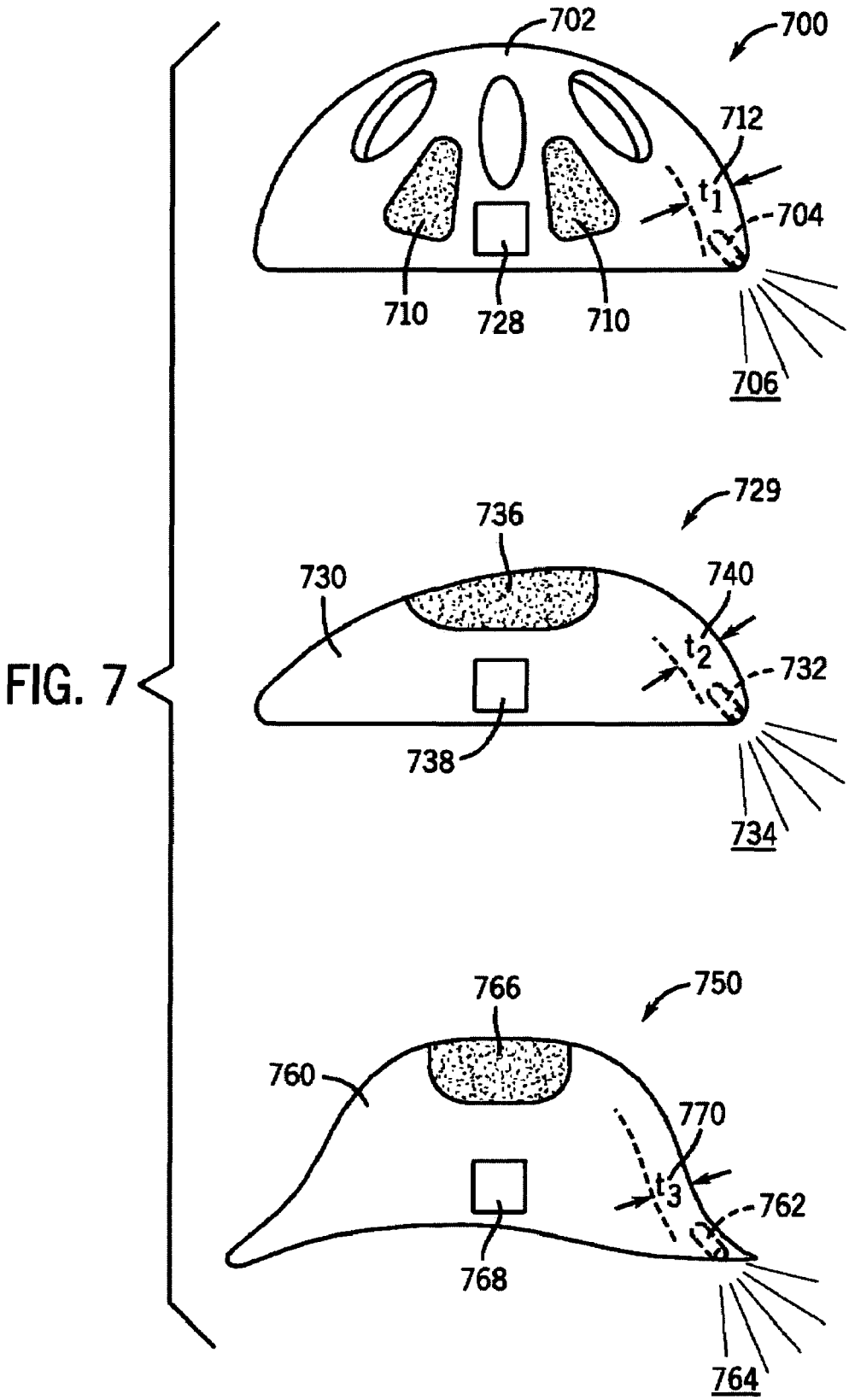
FIG. 7 illustrates different items of head apparel according to embodiments of the invention.

FIG. 7 illustrates different items of head apparel according to embodiments of the invention. With reference to FIG. 7, a light source is integrated into several items of head apparel that do not have bills, as illustrated generally at 700, 729, and 750. In one embodiment, a helmet 702 can be used when riding a bicycle. The helmet 702 includes a light source 704 incorporated into a thickness $t_1$ at 712 of the helmet 702. A power source (not shown) provides power to cause the light source 704 to emit light 706 to aid the vision of a user. In various embodiments, the light source is a LED, a light bulb, a laser diode or a chemiluminescent light source. A switch 728 is located in a place convenient for a user to reach, such as at the side of the helmet. The switch 728 can be located at any other place either on or off of the helmet. In various embodiments, the switch 728 can be located at a place remote from the helmet, such as on the bicycle handle bars, on a wrist strap, etc. Wireless communication can be supplied to allow the remote switch to communicate with its counterpart on the helmet; thereby, allowing the user to manipulate the lighting system remotely. In one embodiment, with a wireless control so configured, a user need not remove his or her hands from the handle bars to operate the lighting system.

In one embodiment, a recharging device 710 is coupled with the helmet 702. In one embodiment, the recharging device 710 is a solar cell that provides conversion of sunlight into an electrical current that is used to charge the power source. In another embodiment, the recharging device 710 is a connection into which an electromotive potential can be applied. The electromotive potential can be generated by an external source such as a charger that is powered by alternating current commonly available from household power outlets (nominally at 115 volts AC).

In one embodiment, a light source 732 is incorporated into a thickness of a helmet 730 that can be used for mountain climbing or skiing. The helmet 730 has a thickness $t_2$ as indicated at 740. The light source 732 emits light 734 to aid the vision of a user. A power source (not shown) provides power to cause the light source 732 to emit light 734 to aid the vision of a user. In various embodiments, the light source is a LED, a light bulb, a laser diode or a chemiluminescent light source. A switch 738 is located in a place convenient for a user to reach, such as at the side of the helmet. The switch 738 can be located at any other place either on or off of the helmet. In various embodiments, the switch 738 can be located at a place remote from the helmet, such as on a ski pole handle, a backpack strap, etc. Wireless communication can be supplied to allow the remote switch to communicate with its counterpart on the helmet; thereby, allowing the user to manipulate the lighting system remotely.

In one embodiment, a recharging device 766 is coupled with the helmet 760. In one embodiment, the recharging device 766 is a solar cell that provides conversion of sunlight into an electrical current that is used to charge the power source. In another embodiment, the recharging device 766 is a connection into which an electromotive potential can be applied. The electromotive potential can be generated by an external source such as a charger that is powered by alternating current commonly available from household power outlets (nominally at 115 volts AC).

In one embodiment, a light source 762 is incorporated into a thickness of a helmet 760 that can be used as a construction hardhat. The helmet 760 has a thickness $t_3$ as indicated at 770. In various embodiments, a power source (not shown) provides power to cause the light source 762 to emit light 764 to aid the vision of a user. In various embodiments, the light source is a LED, a light bulb, a laser diode or a chemiluminescent light source. A switch 768 is located in a place convenient for a user to reach such as the side of the helmet. The switch 768 can be located at any other place either on or off of the helmet.

In one embodiment, a recharging device 766 is coupled with the helmet 760. In one embodiment, the recharging device 766 is a solar cell that provides conversion of sunlight into an electrical current that is used to charge the power source. In another embodiment, the recharging device 766 is a connection into which an electromotive potential can be applied. The electromotive potential can be generated by an external source such as a charger that is powered by alternating current commonly available from household power outlets (nominally at 115 volts AC.

The light sources 704, 732, and 762 are substantially incorporated into the thickness of the respective helmets. In one embodiment, a light source is one or more LEDs which are contained within the thickness of the respective helmets. The light source can include a socket, as described above in conjunction with the previous figures, which receives the LED(s). If an LED is operated at or near maximum forward current, care should be taken to provide sufficient heat sinking to prolong device life. Electrically conductive paths (not shown) provide electrical coupling of the light source to a power source, switches, and if provided, light intensity adjustment controls (dimmer). In one embodiment, the electrically conductive paths are wires that connect the components together to form an electrical circuit. In another embodiment, the electrically conductive paths are flexible metalized paths, as described above in conjunction with the previous figures. In one embodiment, the metalized paths can be formed at a depth within a thickness of a helmet. In one embodiment, the electrically conductive paths are connected to the light source and other components to form a system that is molded into the helmet during construction.

Figure 8:
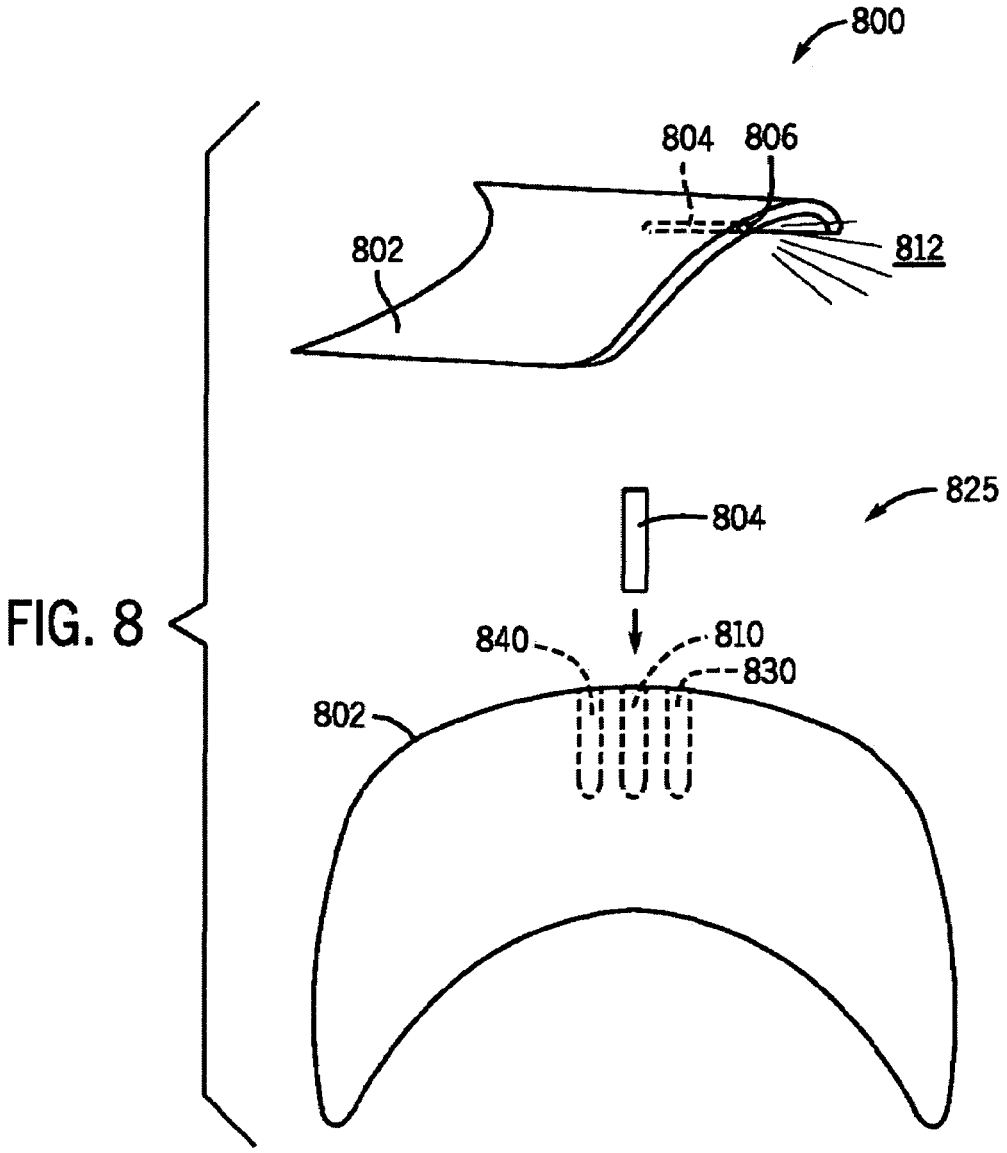
FIG. 8 illustrates a chemiluminescent light source according to one embodiment of the invention.

In one embodiment, a light source can be powered by electrical power sources such as batteries or in another embodiment, a light source can result from a chemiluminescent reaction. FIG. 8 illustrates a chemiluminescent light source according to one embodiment of the invention. With reference to FIG. 8, a bill from an item of head apparel with an incorporated chemiluminescent light source is shown generally at 800 and 825. A bill 802 has a recess 810 into which a chemiluminescent light source 804 is inserted. The chemiluminescent light source 804 has an end 806 that emits light 812. The chemiluminescent light source 804 is a cylindrically shaped unit that is commercially available. The cylindrically shaped chemiluminescent light source 804 is inserted into the recess 810 and is activated by manipulation such as a squeezing deformation imparted by a user (not shown).

A chemiluminescent light source emits light for a period of time, typically 4–6 hours. After a chemiluminescent light source is expended it can be removed from the recess 810 by a user and a new light source is inserted into the recess 810. When the user desires light to assist the user's vision, the user activates the chemiluminescent light source by bending, squeezing, etc. causing the chemiluminescent light source to emit light.

Multiple recesses, such as 830 and/or 840 can be provided into bill 802 to provide a greater luminous intensity to assist the user's vision.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a light source;

a head apparel bill, the head apparel bill is configured to receive the light source, such that the light source is substantially contained within a volume of the head apparel bill;

an upper electrically conductive path fastened to an upper side of the head apparel bill; and a lower electrically conductive path fastened to a lower side of the head apparel bill, wherein the upper electrically conductive path and the lower electrically conductive path are electrically insulated from each other and a user's vision can be assisted by light emitted from the light source.

2. The apparatus of claim 1, wherein the head apparel bill is a head apparel bill insert.

3. The apparatus of claim 1, further comprising:

a power source, the power source is electrically coupled with the light source.

4. The apparatus of claim 3, further comprising:

a recharging device, the recharging device is coupled to the power source.

5. The apparatus of claim 4, wherein the recharging device is a solar cell.

6. The apparatus of claim 5, wherein the recharging device is a connection into which an electromotive potential can be coupled.

7. The apparatus of claim 3, wherein the power source is a battery.

8. The apparatus of claim 3, wherein the power source is a lithium battery.

9. The apparatus, as in claim 3, further comprising:

a switch, the switch is configured to open or to close an electrical circuit used to power the light source.

10. The apparatus of claim 9, wherein the switch includes an integrated circuit.

11. The apparatus of claim 3, wherein the power source is a nickel metal hydride battery.

12. The apparatus of claim 1, wherein an intensity of the light source can be adjusted by the user.

13. The apparatus of claim 1, wherein a color of the light emitted can be changed by the user.

14. The apparatus of claim 13, wherein the color of the light emitted is selected from the group consisting of white, red, blue, green and yellow.

15. The apparatus of claim 1, further comprising:

an optical device, the optical device is configured to adjust a width of an illumination pattern of the light source.

16. The apparatus of claim 15, wherein the optical device is a lens.

17. The apparatus of claim 1, further comprising:

an optical device, the optical device is configured to diffuse the light emitted from the light source.

18. The apparatus of claim 17, wherein the optical device is a diffuser.

19. The apparatus of claim 1, wherein the light source is a light emitting diode (LED).

20. The apparatus of claim 1, the head apparel bill further comprising:

a socket, wherein the light source is releasably coupled with the socket.

21. The apparatus of claim 1, further comprising:

an electrically conductive path coupled to the head apparel bill, wherein the electrically conductive path is insulated.

22. The apparatus of claim 1, further comprising:

an item of head apparel, the item of head apparel is configured to receive the head apparel bill.

23. The apparatus of claim 22, wherein the item of head apparel is a hat.

24. The apparatus of claim 22, wherein the item of head apparel is a visor.

25. The apparatus of claim 22, wherein the item of head apparel is a helmet.

26. The apparatus of claim 22, wherein the item of head apparel is a cap.

27. The apparatus of claim 26, wherein the item of head apparel is a helmet and the helmet is selected from the group consisting of a bicycle helmet, a climbing helmet, a sports helmet and a construction hard hat.

28. The apparatus of claim 1, wherein the light source is a light bulb.

29. The apparatus of claim 1, wherein the light source is a laser.

30. The apparatus of claim 1, wherein the light source is a laser diode.

31. A method comprising:

configuring a head apparel bill to receive a light source, such that the light source can be substantially contained within a volume of the head apparel bill;

applying an upper electrically conductive path to an upper side of the head apparel bill;

applying a lower electrically conductive path to a lower side of the head apparel bill, wherein the upper electrically conductive path and the lower electrically conductive path are electrically insulated from each other and the light source makes electrical contact with the upper electrically conductive path and the lower electrically conductive path when the light source is received by the head apparel bill.

32. The method of claim 31, wherein the head apparel bill is a cap.

33. The method of claim 31, further comprising:

providing a recharging means, wherein the recharging means can provide electrical power to the light source.

34. The method of claim 31, wherein the head apparel bill is a head apparel bill insert.

35. The method of claim 31, wherein the item of head apparel is selected from the group consisting of a cap, a hat, a visor, and a helmet.

36. The method of claim 35, wherein the helmet is selected from the group consisting of a bicycle helmet, a climbing helmet, a sports helmet and a construction hard hat.

37. The method of claim 31, wherein the head apparel bill is used in a hat.

38. The method of claim 31, wherein the head apparel bill is used in a visor.

39. The method of claim 31, wherein the head apparel bill is used in a helmet.

40. An apparatus comprising:

a hat having a bill;

an upper electrically conductive path fastened to an upper side of the bill;

a lower electrically conductive path fastened to a lower side of the bill, wherein the upper electrically conductive path and the lower electrically conductive path are electrically insulated from each other;

a light emitting diode (LED) mounted within the bill;

a power source configured to provide power to the LED, the power source is contained within a volume of the hat; and a switch configured to cause power to be interrupted to the LED, the switch is contained within the volume of the hat; such that a user can wear the hat and receive vision assistance by light emitted from the LED.

41. The apparatus of claim 40, further comprising:

a recharging device, the recharging device is coupled to the power source.

42. The apparatus of claim 41, wherein the recharging device is a solar cell.

43. The apparatus of claim 42, wherein the recharging device is a connection into which an electromotive potential can be coupled.

44. The apparatus of claim 40, wherein the power source is a battery.

45. The apparatus of claim 40, wherein an intensity of the light source can be adjusted by the user.

46. The apparatus of claim 40, wherein a color of the light emitted can be changed by the user.

47. The apparatus of claim 46, wherein the color of the light emitted is selected from the group consisting of white, red, blue, green and yellow.

48. The apparatus of claim 40, wherein the switch includes an integrated circuit.

49. The apparatus of claim 40, wherein the power source is a lithium battery.

50. The apparatus of claim 40, wherein the power source is a and a nickel metal hydride battery.

51. An apparatus comprising:

a light source;

a head apparel bill, the head apparel bill is configured to receive the light source, such that the light source is substantially contained within a volume of the head apparel bill;

an upper electrically conductive path fastened to an upper side of the head apparel bill;

a lower electrically conductive path fastened to a lower side of the head apparel bill, wherein the upper electrically conductive path and the lower electrically conductive path are electrically insulated from each other, the upper electrically conductive path and the lower electrically conductive path are electrically coupled to the light source;

a power source, the power source is electrically coupled with the light source, the power source occupies a portion of a volume of an item of head apparel; and a switch, the switch is configured to open or close an electrical circuit used to power the light source.

52. The apparatus of claim 51, wherein the item of head apparel is a hat.

53. The apparatus of claim 51, wherein the light source is a light emitting diode (LED).

54. The apparatus of claim 51, wherein the switch includes an integrated circuit.

55. The apparatus of claim 51, wherein the item of head apparel is a visor.

56. The apparatus of claim 51, wherein the item of head apparel is a cap.

57. The apparatus of claim 51, wherein the item of head apparel is a helmet.

* * * * *